US007318682B2

(12) United States Patent
Anderson

(10) Patent No.: US 7,318,682 B2
(45) Date of Patent: Jan. 15, 2008

(54) APPARATUS FOR USING LIQUIDS IN BATHING

(76) Inventor: Todd A. Anderson, 2983 Dorothy Dr., Aurora, IL (US) 60504

( * ) Notice: Subject to any disclaimer, the term of this patent is extended or adjusted under 35 U.S.C. 154(b) by 0 days.

(21) Appl. No.: 10/864,027

(22) Filed: Jun. 9, 2004

(65) Prior Publication Data

US 2006/0072961 A1 Apr. 6, 2006

(51) Int. Cl.
*B43K 5/00* (2006.01)
*B43K 8/12* (2006.01)
*B43M 11/06* (2006.01)

(52) U.S. Cl. ..... 401/205; 401/207; 401/183

(58) Field of Classification Search ..... 401/183–186, 401/201, 203–205, 207; 15/104.92, 229.11
See application file for complete search history.

(56) References Cited

U.S. PATENT DOCUMENTS 5,944,032 A * 8/1999 Masterson ..... 132/290
6,039,491 A * 3/2000 Badillo ..... 401/186
6,161,246 A * 12/2000 Trachtenberg ..... 15/229.13
6,368,003 B1 * 4/2002 Sorrell ..... 401/185
6,883,994 B1 * 4/2005 Grogg ..... 401/201

* cited by examiner

*Primary Examiner*—David J. Walczak
(74) *Attorney, Agent, or Firm*—Vedder, Price, Kaufmann & Kammholz, P.C.; W. Dennis Drehkoff

(57) ABSTRACT

An apparatus for using liquids in bathing, to be used as a cleanser in bathing, comprises a pouf attached by a support to a squeezable container that contains a bathing liquid such as a liquid bathing detergent, a liquid soap, or either or both of these, combined with lotions or the like. When the squeezable container is squeezed, it delivers liquid from the squeezable container to the pouf to apply the liquid to the skin of the bather. A check valve admits replacement air to the squeezable container but keeps the liquid in when the squeezable container is not squeezed.

7 Claims, 3 Drawing Sheets

APPARATUS FOR USING LIQUIDS IN BATHING

This invention relates to an apparatus for dispensing or administering liquids while bathing. More specifically, the invention relates to a pouf attached to a squeezable container holding a bathing liquid. When the container is squeezed, the liquid is delivered from the container to the pouf for application to the skin of the bather.

BACKGROUND OF THE INVENTION

This invention is an apparatus for using liquids with a puff or pouf or sponge in a bath or shower. It is useful for anyone bathing or showering, but it is particularly useful as a mildly abrasive scrubber for the skin that applies soap or a liquid detergent.

There are many known devices for holding soap or cleansing liquids for application to a bather in the bath. For example, U.S. Pat. No. 6,326,339, entitled "Cleansing System Comprising Synthetic Detergent Bar and Pouf," issued Dec. 4, 2001, teaches a combination of a detergent bar and a hand-held bath sponge or pouf. A pouf is a small fluffy pad or wrapping of plastic gauze or the like for applying liquids or powder; in the bath it is useful for applying soap and as a gentle abrasive device for rubbing the skin of a bather. Other known devices allow the combination of soap or other detergent with a deriding applicator to assist in scrubbing the skin of a person in a bath or shower, although the known devices use soap or detergent bars rather than a liquid soap or detergent or combination of these with other additives.

It would be of use to provide a device that combines the application of a liquid that contains one or more of liquid soap, liquid detergents, lotions and emollients or the like for the skin with a pouf or puff to apply the liquid to the skin and to allow the skin to be scrubbed clean.

SUMMARY OF THE INVENTION

An apparatus for using liquids in bathing includes a puff or pouf that is attached to a holder. A squeezable container can be attached to the holder to apply a liquid to the puff or pouf to scrub an object such as the skin of a bather. This allows controlled administration, by squeezing, of a mixture of liquid soap or detergent and the addition of other liquids of choice to the liquid to be applied with the liquid to the skin.

BRIEF DESCRIPTION OF THE DRAWINGS

Further aspects and advantages of the invention will become apparent from the following discussion taken together with the accompanying drawing in with.

DETAILED DESCRIPTION OF THE INVENTION

Figure 1:
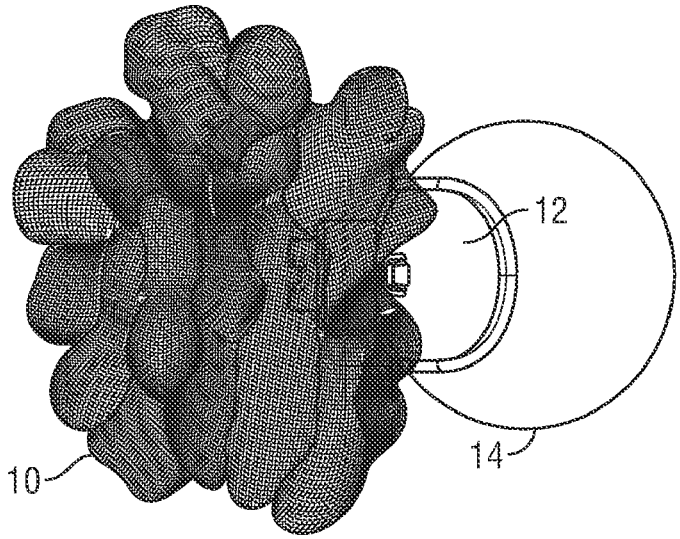
FIG. 1 is a perspective view of an apparatus for the practice of the present invention.

Referring now is more detail to the drawings in which like reference numbers represent like parts throughout several views, FIG. 1 is a perspective view of an apparatus for the practice of the present invention. In FIG. 1, a pouf 10 is connected to a support 12 that is threaded on neck 13 to hold a squeezable container 14 that is capable of holding liquid soap or detergent and any additives, such as lotions or emollients, that are desired. The squeezable container 14 also serves as a handle for the user who practices the invention.

Figure 2:
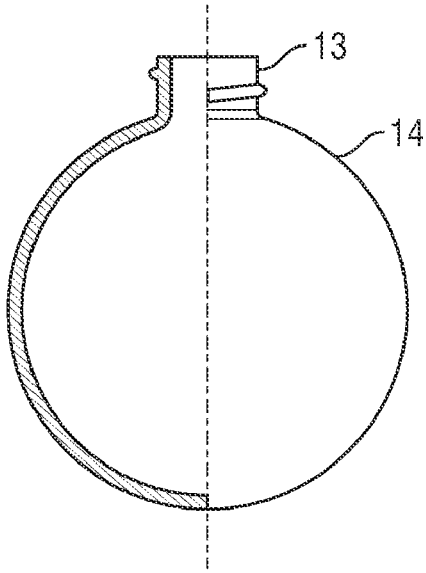
FIG. 2 is a partial sectional view of the squeezable container of FIG. 1.
Figure 3:
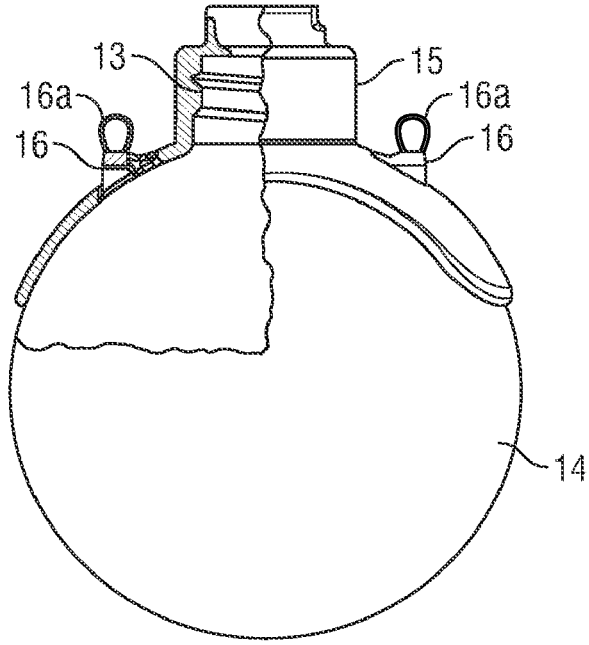
FIG. 3 is a partial sectional side view of the support of FIG. 1.
Figure 4:
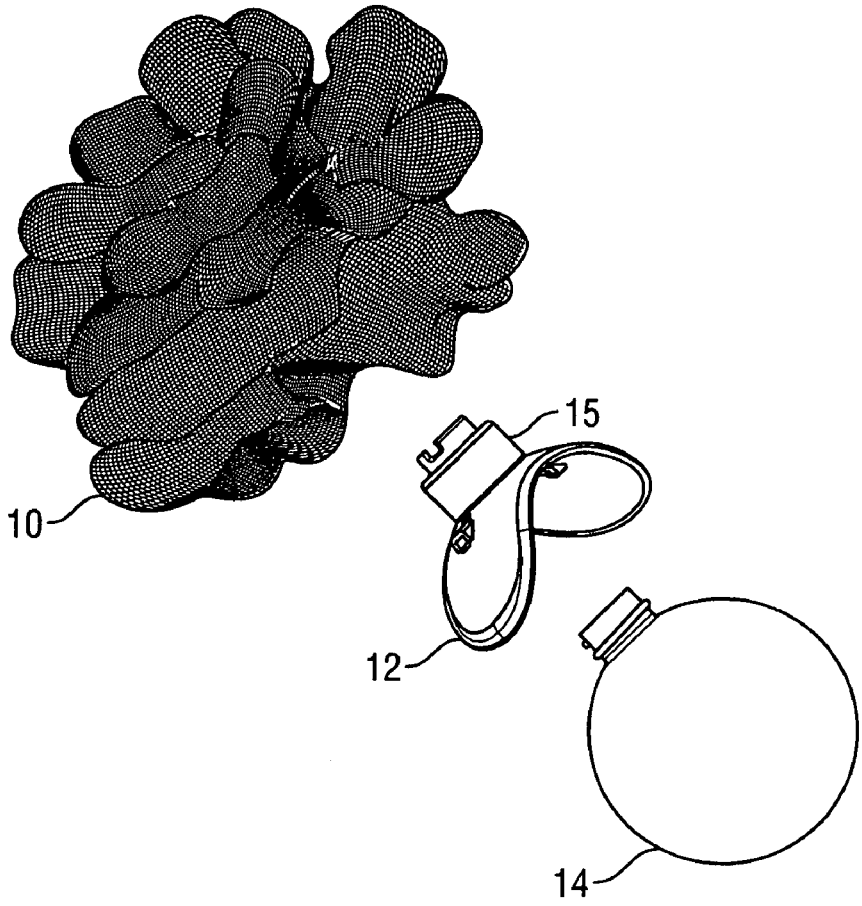
FIG. 4 is an exploded view of the apparatus of FIG. 1, taken along a centerline of the apparatus of FIG. 1.

FIG. 2 is a partial sectional view of the squeezable container 14 of FIG. 1, FIG. 3 is a partial sectional side view of the support 12 of FIG. 1, and FIG. 4 is an exploded view of the apparatus of FIG. 1, taken along a centerline of the apparatus of FIG. 1. In FIGS. 2, 3, and 4, the squeezable container 14 is shown as substantially spherical, which is only one of many possible shapes of a squeezable container with threads. The shape is a matter of design choice. The squeezable container 14 is also shown here as a part which makes the invention complete, but it could be replaced by any bottle of bath liquid or the like that can be connected to the support 12. A nozzle 15 is attached to the support 12 to supply liquid to the pouf 10 from the squeezable container 14. The support 12 includes a pair of connection points 16 that can be used to hold a flexible tie **16*a* such as a strip of plastic or the like, a piece of string or cord, or a wire tie to attached the pouf 10 to the support 12**.

Figure 5:
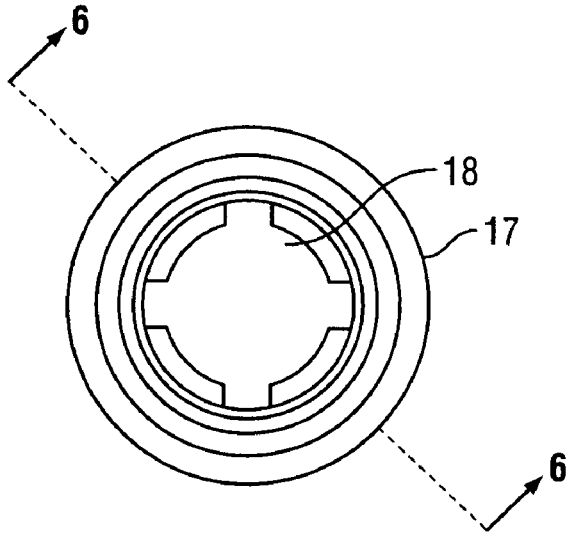
FIG. 5. is a top view of a retainer in the neck of the squeezable container, FIG. 6. is a sectional view of the retainer taken at line 6-6 of FIG. 5, and FIG. 7. is a check valve and a retainer that connects the check valve to the support.

FIG. 5 is top view of a retainer 17 with center member 18 for directing the flow of liquid through nozzle 15 when container 14 is squeezed. It is inserted in support 12. The center member 18 is attached to an inside wall 19 of the retainer 17.

Figure 6:
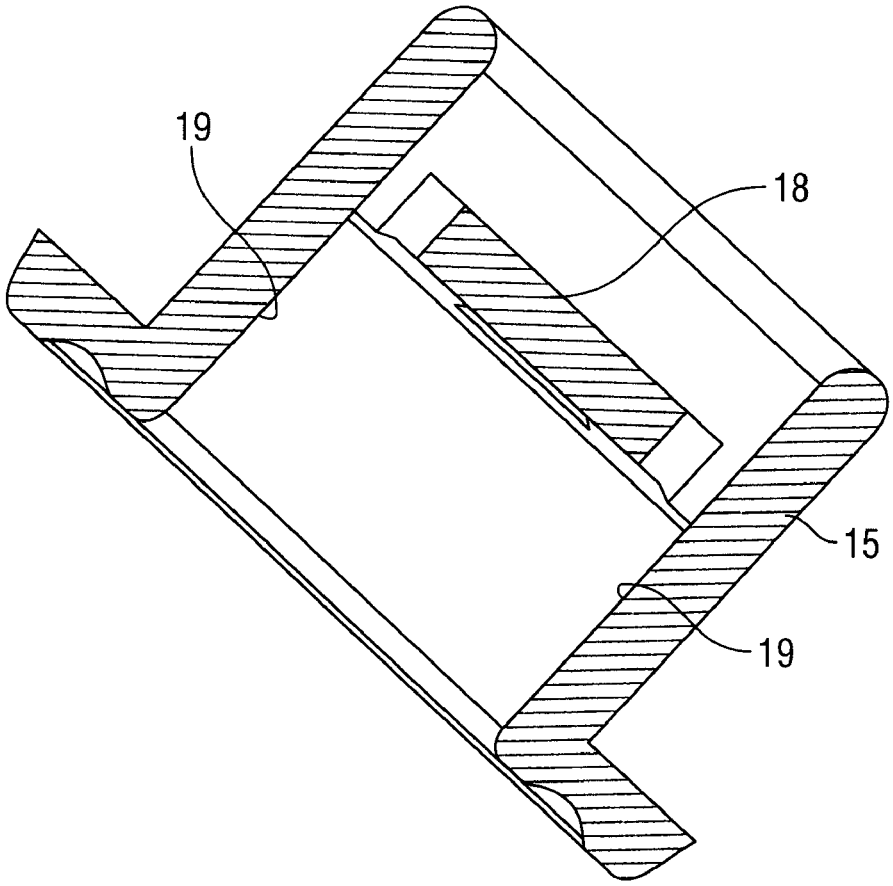

FIG. 6 is a sectional view of the retainer of FIG. 5 taken along line 6-6 of FIG. 5. and center 18 showing the center member within wall 19 of nozzle 15.

Figure 7:
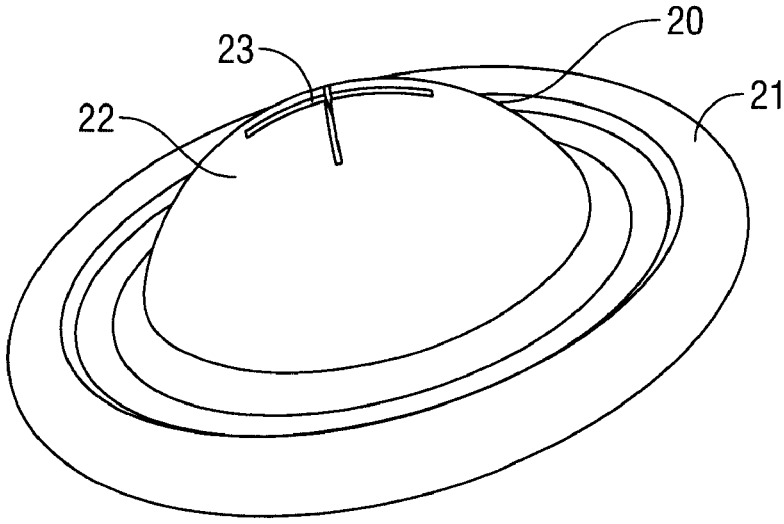

FIG. 7 is a check valve 20 connected to the support 12 by the retainer 17, which in turn engages in a force fit with the support 12. The check valve 20 has a ring 21 which engages the retainer 17 and the nozzle 15 to hold the check valve 20 in place, and a protrusion 22 that contains cut 23. This lets liquid from the squeezable container 14 be forced through the retainer 17 and the nozzle 15, permits air to enter the squeezable container 14 when pressure on the squeezable container 14 is relaxed, and keeps liquid in the squeezable container 14 otherwise. This lets the squeezable container 14 recover its shape after it is squeezed to emit liquid into the pouf 10. The protrusion 22 is inside the retainer 17 so that it resists the flow of liquid from the squeezable container 14 until the check valve 20 is overcome. The check valve 20 operates more readily in the opposite direction to permit the flow of air.

In operation, the pouf 10, support 12, nozzle 15, and check valve 20 can be removed from the neck 13 of the squeezable container 14. The squeezable container 14 can be filled with the desired liquid. When the support 12 is then replaced on the neck of the squeezable container 14, the apparatus is ready for use. Squeezing the squeezable container 14 then forces the liquid through check valve 20 into the nozzle 15 and around center member 18 into the pouf 10.

While the present invention has been described with respect to a preferred embodiment, many modifications and variations can be made to persons skilled in the art.

What is claimed is:

1. An apparatus for using liquids in bathing comprising:

a pouf;

a support connected to the pouf by a pair of connecting points, each connecting point having a flexible tie for attaching the pouf to the support; and a squeezable container connected to the support to deliver liquid from the squeezable container to the pouf when the squeezable container is squeezed.

2. The apparatus of claim 1 wherein the pouf is a wad of plastic gauze.

3. The apparatus of claim 1 wherein the support is connected to a check valve to pass liquid to the pouf when the squeezable container is squeezed, to admit air to the squeezable container when pressure on the squeezable container is released, and to keep liquid in the squeezable container otherwise.

4. The apparatus of claim 3 wherein the support is connected to the check valve by a retainer.

5. The apparatus of claim 1 wherein the flexible ties are plastic ties.

6. The apparatus of claim 1 wherein the flexible ties are wire ties.

7. The apparatus of claim 1 wherein the flexible ties are pieces of string.

* * * * *